US009972891B2

(12) United States Patent
Ayala Vazquez et al.

(10) Patent No.: US 9,972,891 B2
(45) Date of Patent: May 15, 2018

(54) ELECTRONIC DEVICE ANTENNA WITH ISOLATION MODE

(71) Applicant: Apple Inc., Cupertino, CA (US)

(72) Inventors: Enrique Ayala Vazquez, Watsonville, CA (US); Hongfei Hu, Santa Clara, CA (US); Nanbo Jin, Milpitas, CA (US); Matthew A. Mow, Los Altos, CA (US); Liang Han, Sunnyvale, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 26 days.

(21) Appl. No.: 14/819,280

(22) Filed: Aug. 5, 2015

(65) Prior Publication Data

US 2017/0040668 A1 Feb. 9, 2017

(51) Int. Cl.

| | |
|---|---|
| ***H01Q 1/24*** | (2006.01) |
| ***H01Q 9/42*** | (2006.01) |
| ***H01Q 13/10*** | (2006.01) |
| ***H01Q 5/328*** | (2015.01) |
| ***H01Q 5/335*** | (2015.01) |
| ***H01Q 5/378*** | (2015.01) |

(52) U.S. Cl.

CPC ..... *H01Q 1/243* (2013.01); *H01Q 5/328* (2015.01); *H01Q 5/335* (2015.01); *H01Q 5/378* (2015.01); *H01Q 9/42* (2013.01); *H01Q 13/106* (2013.01)

(58) Field of Classification Search

CPC ..... H01Q 1/243; H01Q 7/00; H01Q 9/14; H01Q 21/28; H01Q 9/42; H01Q 1/44; H01Q 5/328; H01Q 5/335; H01Q 5/378

USPC ..... 343/702, 700 MS, 767

See application file for complete search history.

(56) References Cited

U.S. PATENT DOCUMENTS

| | | | |
|---|---|---|---|
| 8,269,674 | B2 | 9/2012 | Camacho et al. |
| 8,368,602 | B2 | 2/2013 | Hill et al. |
| 8,441,404 | B2 | 5/2013 | Chiang et al. |
| 8,723,748 | B2 | 5/2014 | Svensson |

(Continued)

FOREIGN PATENT DOCUMENTS

| | | | |
|---|---|---|---|
| JP | H05-167336 | A | 7/1993 |
| WO | 2010035528 | A1 | 4/2010 |

(Continued)

*Primary Examiner* — Hoang Nguyen

(74) *Attorney, Agent, or Firm* — Treyz Law Group, P.C.; G. Victor Treyz; Michael H. Lyons

(57) ABSTRACT

An electronic device may have wireless circuitry with antennas. An antenna resonating element arm for a given antenna may be formed from metal structures supported by a plastic carrier. The antenna resonating element arm may be coupled to switching circuitry to isolate the antenna resonating element arm when the antenna resonating element arm is not being used to handle communications in a communications band. The electronic device may have a metal housing. A slot may separate a peripheral portion of the housing such as a sidewall portion from a planar rear portion. The sidewall portion and the planar rear portion may form an additional antenna that operates at communications frequencies outside of the communications band handled by the given antenna. A parasitic antenna resonating element arm may be formed in the slot to enhance the frequency response of the additional antenna.

21 Claims, 10 Drawing Sheets

(56) References Cited

U.S. PATENT DOCUMENTS

| | | | | |
|---|---|---|---|---|
| 8,836,587 | B2 * | 9/2014 | Darnell | H01Q 1/243 343/700 MS |
| 8,947,310 | B2 | 2/2015 | Cheng et al. | |
| 8,995,934 | B2 * | 3/2015 | Yu | H04B 1/0057 455/553.1 |
| 9,041,617 | B2 * | 5/2015 | Sorensen | H01Q 7/005 343/745 |
| 9,166,279 | B2 | 10/2015 | Jin et al. | |
| 9,559,433 | B2 | 1/2017 | Zhou et al. | |
| 2007/0115183 | A1 * | 5/2007 | Kim | H01Q 1/243 343/700 MS |
| 2012/0229347 | A1 * | 9/2012 | Jin | H01Q 1/243 343/702 |
| 2012/0231750 | A1 * | 9/2012 | Jin | H01Q 7/005 455/77 |
| 2013/0050046 | A1 | 2/2013 | Jarvis et al. | |
| 2013/0257659 | A1 | 10/2013 | Darnell et al. | |
| 2014/0266938 | A1 | 9/2014 | Ouyang et al. | |
| 2015/0116179 | A1 * | 4/2015 | Mikata | H01Q 1/2291 343/845 |
| 2015/0311579 | A1 * | 10/2015 | Irci | H01Q 1/243 343/702 |
| 2016/0254591 | A1 * | 9/2016 | Jung | G06F 1/1626 343/702 |

FOREIGN PATENT DOCUMENTS

| | | |
|---|---|---|
| WO | 2012160820 | 11/2012 |
| WO | 2014149150 | 9/2014 |

* cited by examiner

ELECTRONIC DEVICE ANTENNA WITH ISOLATION MODE

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures.

It would therefore be desirable to be able to provide improved wireless circuitry for electronic devices such as electronic devices that include conductive housing structures.

SUMMARY

An electronic device may have wireless circuitry with antennas. An antenna resonating element arm for an antenna may be formed from metal structures supported by a plastic carrier. The antenna resonating element arm may be coupled to a transceiver using switching circuitry. Control circuitry may be used to place the switching circuitry in either a state that couples the transceiver to the antenna or that isolates the transceiver from the antenna. When the antenna is isolated, an additional antenna may be used by the transceiver to transmit and receive wireless signals.

The electronic device may have a metal housing. A slot may separate a peripheral portion of the housing such as a sidewall portion from a planar rear portion. The additional antenna may be formed from the sidewall portion and the planar rear portion. The antenna and additional antenna may operate in different communications bands. A parasitic antenna resonating element arm may be formed in the slot to enhance the frequency response of this additional antenna. The antenna resonating element arm for the antenna may have multiple segments coupled at bends. The segments may include a segment that overlaps the slot and runs parallel to the slot.

DETAILED DESCRIPTION

Figure 1:
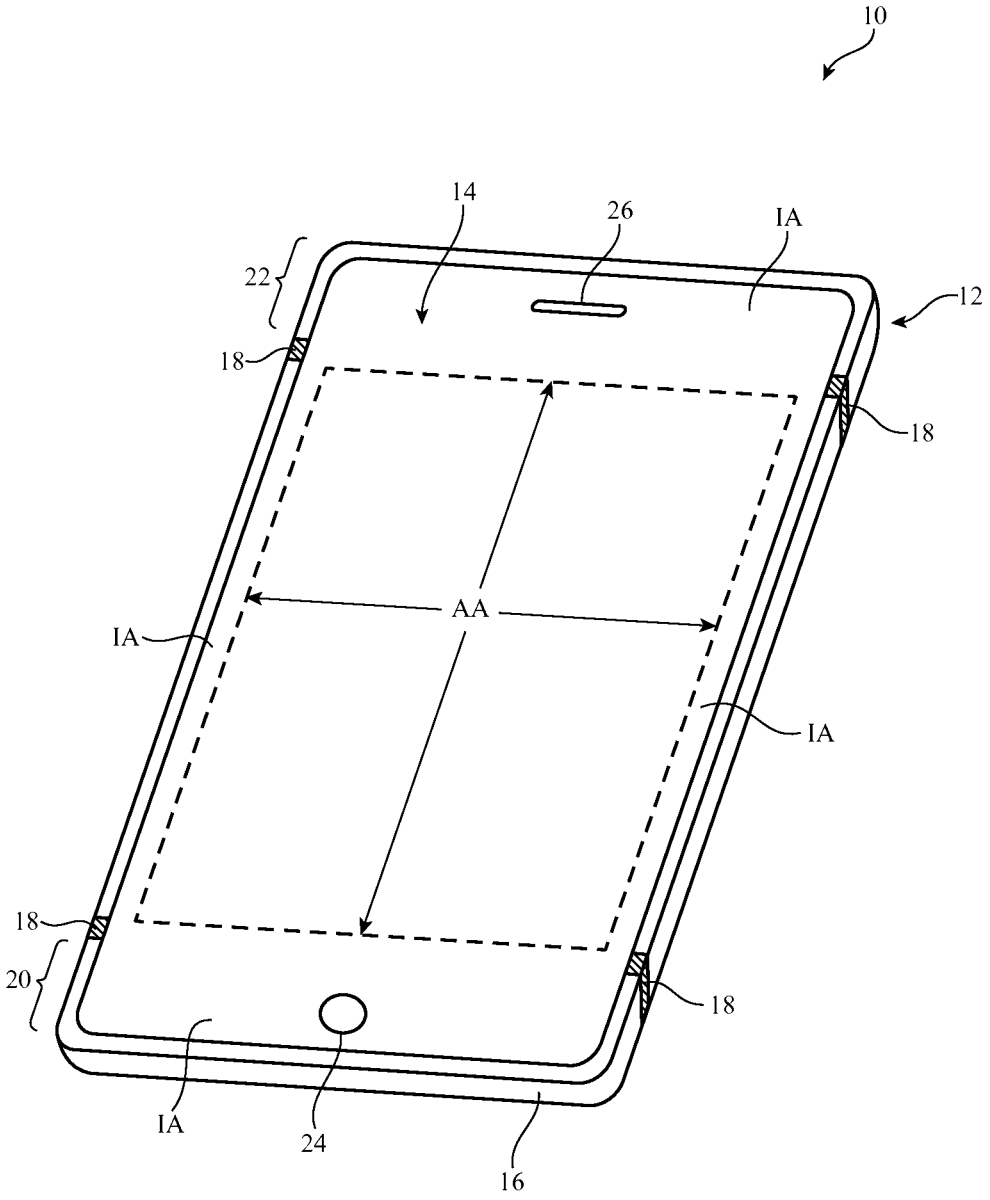
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a planar housing wall. The rear housing wall may be have slots that pass entirely through the rear housing wall and that therefore separate housing wall portions (and/or sidewall portions) of housing 12 from each other. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is not necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalls that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16). Device 10 may also include conductive structures such as printed circuit boards, components mounted on printed circuit boards, and other internal conductive structures. These conductive structures, which may be used in forming a ground plane in device 10, may be located in the center of housing 12 and may extend under active area AA of display 14.

In regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air, plastic, and other dielectrics and may be used in forming slot antenna resonating elements for one or more antennas in device 10.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22. In configurations for device 10 with narrow U-shaped openings or other openings that run along the edges of device 10, the ground plane of device 10 can be enlarged to accommodate additional electrical components (integrated circuits, sensors, etc.)

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
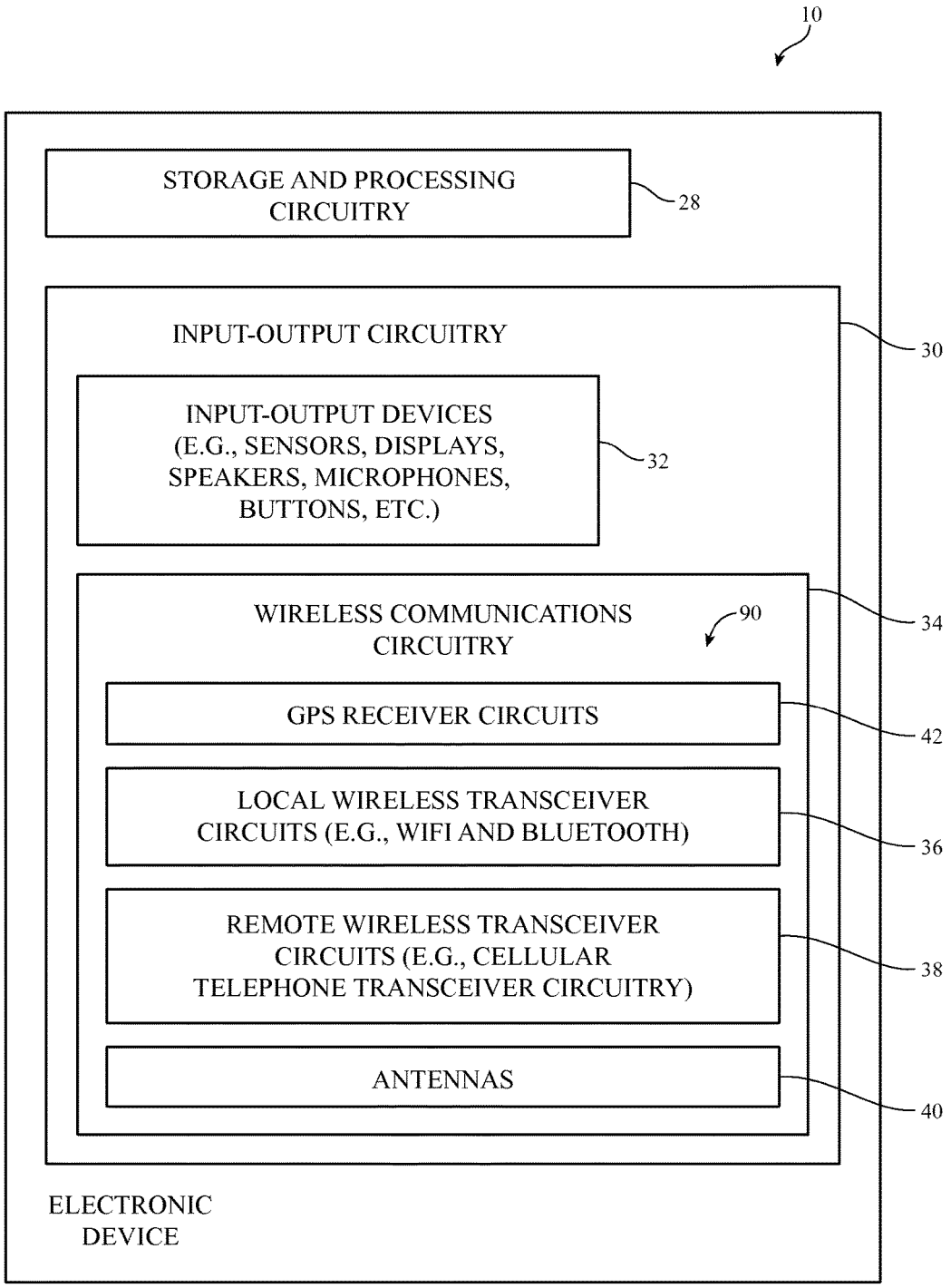
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low-midband from 960-1710 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
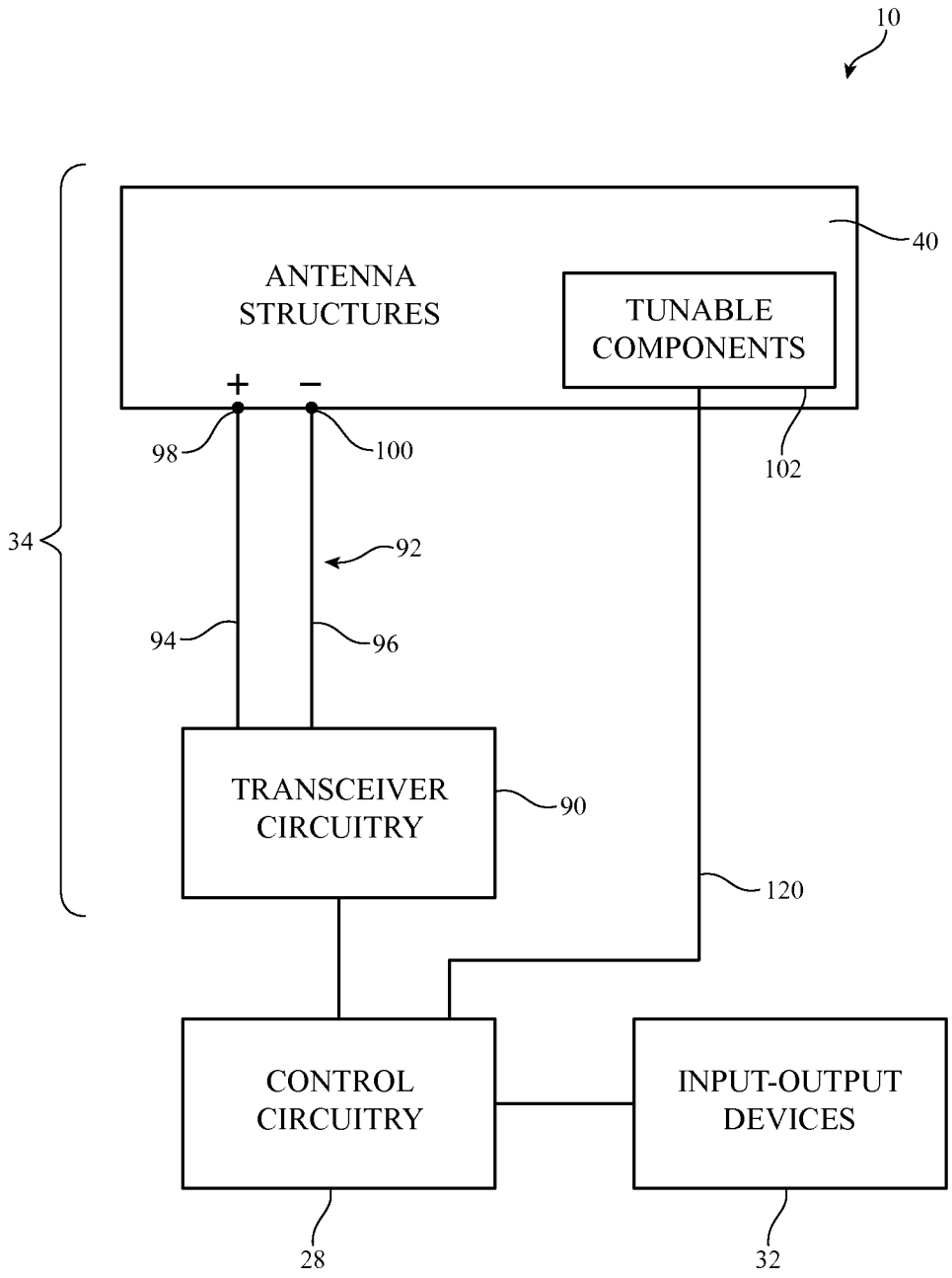
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna(s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 120 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 100. Other types of antenna feed arrangements may be used if desired. For example, antenna structures 40 may be fed using multiple feeds. The illustrative feeding configuration of FIG. 3 is merely illustrative.

Control circuitry 28 may use an impedance measurement circuit to gather antenna impedance information. Control circuitry 28 may use information from a proximity sensor (see, e.g., sensors 32 of FIG. 2), received signal strength information, device orientation information from an orientation sensor, information from one or more antenna impedance sensors, or other information in determining when antenna 40 is being affected by the presence of nearby external objects or is otherwise in need of tuning. In response, control circuitry 28 may adjust an adjustable inductor, adjustable capacitor, switch, or other tunable component 102 to ensure that antenna 40 operates as desired. Adjustments to component 102 may also be made to extend the coverage of antenna 40 (e.g., to cover desired communications bands that extend over a range of frequencies larger than antenna 40 would cover without tuning).

Figure 4:
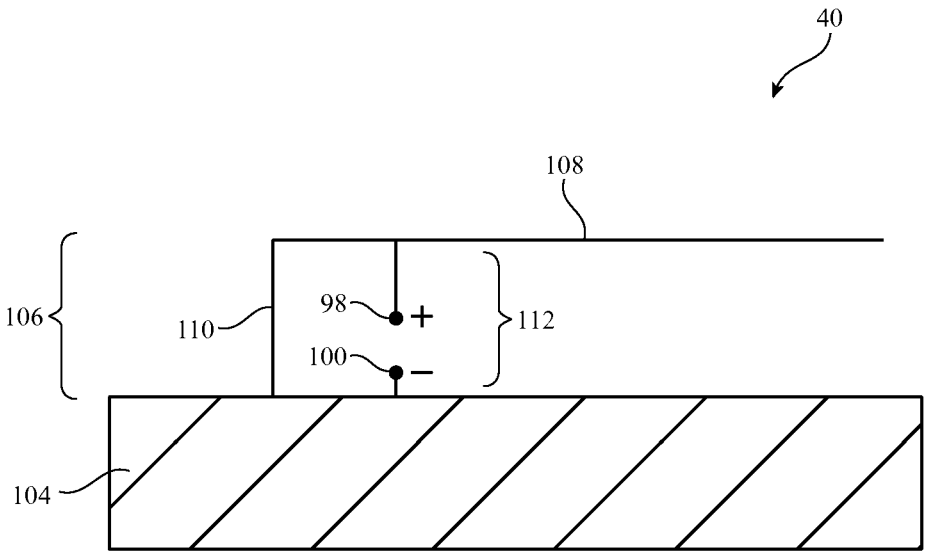
FIG. 4 is a schematic diagram of an illustrative inverted-F antenna in accordance with an embodiment.

FIG. 4 is a diagram of illustrative inverted-F antenna structures that may be used in implementing antenna 40 for device 10. Inverted-F antenna 40 of FIG. 4 has antenna resonating element 106 and antenna ground (ground plane) 104. Antenna resonating element 106 may have a main resonating element arm such as arm 108. The length of arm 108 and/or portions of arm 108 may be selected so that antenna 40 resonates at desired operating frequencies. For example, if the length of arm 108 may be a quarter of a wavelength at a desired operating frequency for antenna 40. Antenna 40 may also exhibit resonances at harmonic frequencies.

Main resonating element arm 108 may be coupled to ground 104 by return path 110. An inductor or other component may be interposed in path 110 and/or tunable components 102 may be interposed in path 110 and/or coupled in parallel with path 110 between arm 108 and ground 104.

Antenna 40 may be fed using one or more antenna feeds. For example, antenna 40 may be fed using antenna feed 112. Antenna feed 112 may include positive antenna feed terminal 98 and ground antenna feed terminal 100 and may run in parallel to return path 110 between arm 108 and ground 104. If desired, inverted-F antennas such as illustrative antenna 40 of FIG. 4 may have more than one resonating arm branch (e.g., to create multiple frequency resonances to support operations in multiple communications bands) or may have other antenna structures (e.g., parasitic antenna resonating elements, tunable components to support antenna tuning, etc.). For example, arm 108 may have left and right branches that extend outwardly from feed 112 and return path 110. Multiple feeds may be used to feed antennas such as antenna 40.

Figure 5:
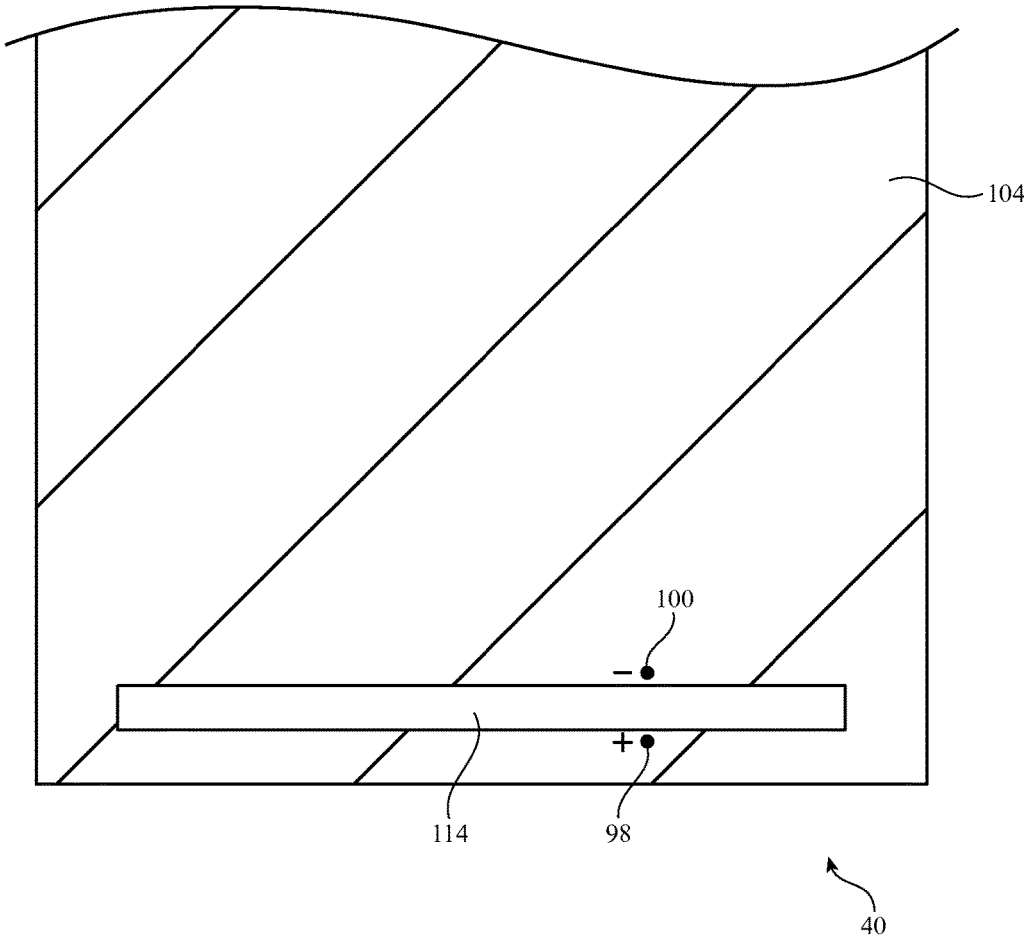
FIG. 5 is a schematic diagram of an illustrative slot antenna in accordance with an embodiment of the present invention.

Antenna 40 may be a hybrid antenna that includes one or more slot antenna resonating elements. As shown in FIG. 5, for example, antenna 40 may be based on a slot antenna configuration having an opening such as slot 114 that is formed within conductive structures such as antenna ground 104. Slot 114 may be filled with air, plastic, and/or other dielectric. The shape of slot 114 may be straight or may have one or more bends (i.e., slot 114 may have an elongated shape following a meandering path). The antenna feed for antenna 40 may include positive antenna feed terminal 98 and ground antenna feed terminal 100. Feed terminals 98 and 100 may, for example, be located on opposing sides of slot 114 (e.g., on opposing long sides). Slot-based antenna resonating elements such as slot antenna resonating element 114 of FIG. 5 may give rise to an antenna resonance at frequencies in which the wavelength of the antenna signals is equal to the perimeter of the slot. In narrow slots, the resonant frequency of a slot antenna resonating element is associated with signal frequencies at which the slot length is equal to a half of a wavelength. Slot antenna frequency response can be tuned using one or more tunable components such as tunable inductors or tunable capacitors. These components may have terminals that are coupled to opposing sides of the slot (i.e., the tunable components may bridge the slot). If desired, tunable components may have terminals that are coupled to respective locations along the length of one of the sides of slot 114. Combinations of these arrangements may also be used.

Figure 6:
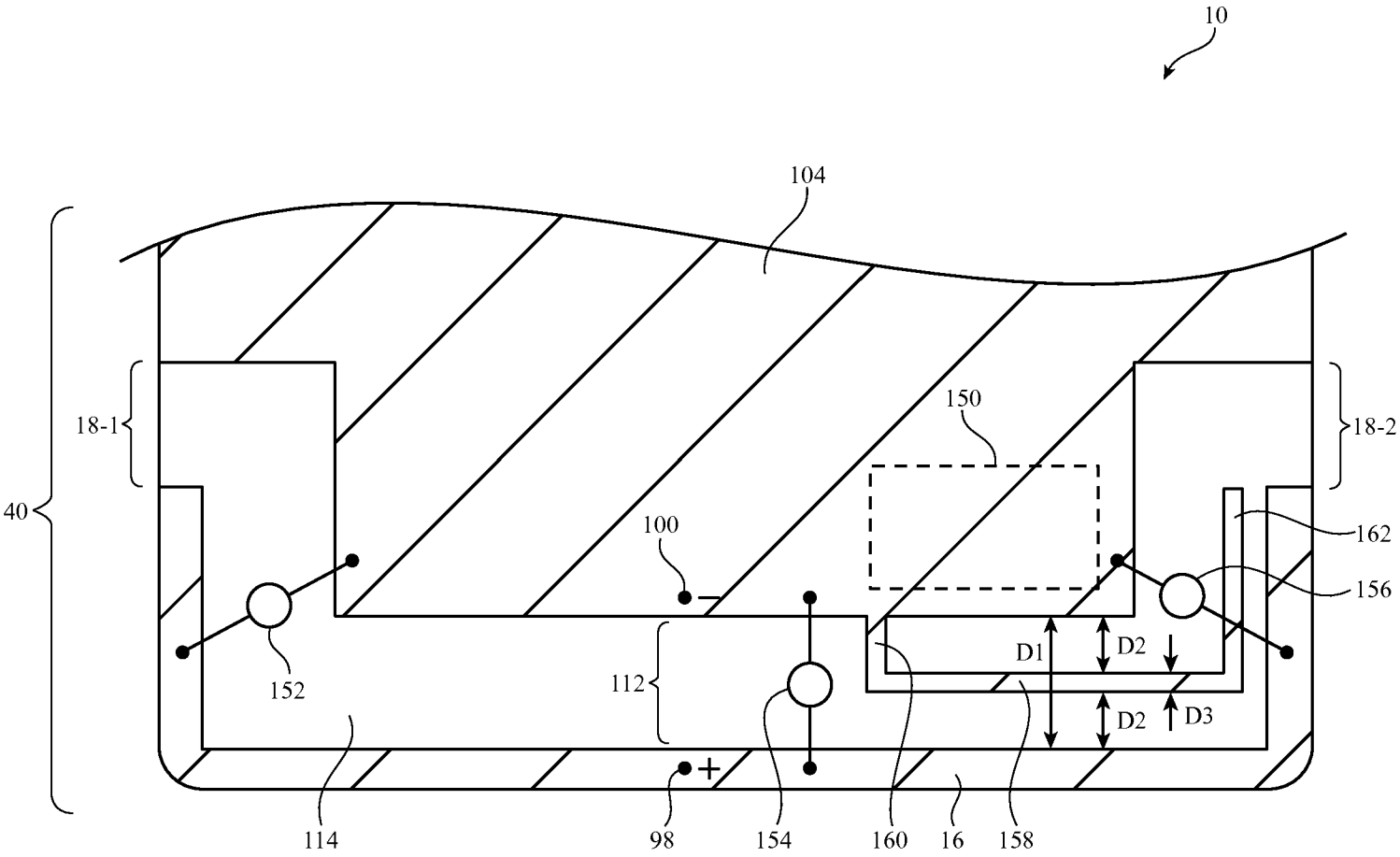
FIGS. 6 and 7 are diagrams of illustrative antenna structures that include a parasitic antenna resonating element arm embedded within an antenna slot in accordance with an embodiment.

Antenna 40 may be a hybrid slot-inverted-F antenna that includes resonating elements of the type shown in both FIG. 4 and FIG. 5. An illustrative configuration for an antenna with slot and inverted-F antenna structures is shown in FIG. 6. As shown in FIG. 6, antenna 40 (e.g., a hybrid slot-inverted-F antenna) may be fed by transceiver circuitry that is coupled to antenna feed 112. One or more additional feeds may be coupled to antenna 40, if desired. Antenna 40 may include a slot such as slot 114 that is formed from an elongated gap between peripheral conductive structures 16 and ground 104 (e.g., a slot formed in housing 12 using machining tools or other equipment). The slot may be filled with dielectrics such as air and/or plastic. For example, plastic may be inserted into the portions of slot 114 that are flush with the outside of housing 12.

Portions of slot 114 may contribute slot antenna resonances to antenna 40. Peripheral conductive structures 16 may form an antenna resonating element arm such as arm 108 of FIG. 4 that extends between gaps 18-1 and 18-2 (e.g., gaps 18 in peripheral conductive structures 16). A return path such as path 110 of FIG. 4 may be formed by a fixed conductive path bridging slot 114 or an adjustable component such as a switch that can be closed to form a short circuit across slot 114.

To enhance frequency coverage for antenna 40, antenna 40 may be provided with a parasitic antenna resonating element such as parasitic antenna resonating element 158. Device 10 may also have one or more supplemental antennas such as antenna 150 to enhance the frequency coverage of antenna 40. Antenna 150 may be fed using a feed that is separate from feed 112.

Optional adjustable components such as components 152, 154, and 156 may be used in adjusting the operation of antenna 40. Components 152, 154, and 156 may include switches, switches coupled to fixed components such as inductors and capacitors and other circuitry for providing adjustable amounts of capacitance, adjustable amounts of inductance, etc. Adjustable components in antenna 40 may be used to tune antenna coverage, may be used to restore antenna performance that has been degraded due to the presence of an external object such as a hand or other body part of a user, and/or may be used to adjust for other operating conditions and to ensure satisfactory operation at desired frequencies.

Parasitic antenna resonating element 158 may have a first end such as end 160 that protrudes into slot 114 from antenna ground 104 at a given location along the length of slot 114 and may have a second end such as end 162 that lies within slot 114. Slot 114 may have an elongated shape (e.g., a slot shape) or other suitable elongated gap shape. In the example of FIG. 6, slot 114 has a U shape that runs along the periphery of device 10 between peripheral conductive structures 16 (e.g., housing sidewalls) and portions of the rear wall of device 10 (e.g., ground 104). In this type of configuration, parasitic antenna resonating element 158 may extend from end 160 to end 162 along the length of slot 114 without touching peripheral conductive structures 16 or ground 104 on the opposing side of slot 114 (i.e., without allowing the edges of element 158 to contact the inner surfaces of the metal housing forming slot 114).

The length of slot 114 may be about 4-20 cm, more than 2 cm, more than 4 cm, more than 8 cm, more than 12 cm, less than 25 cm, less than 15 cm, less than 10 cm, or other suitable length. Element 158 may have a width D3 of about 0.5 mm (e.g., less than 0.8 mm, less than 0.6 mm, more than 0.3 mm, 0.4 to 0.6 mm, etc.) or other suitable width. Slot 114 may have a width of about 2 mm (e.g., less than 4 mm, less than 3 mm, less than 2 mm, more than 1 mm, more than 1.5 mm, 1-3 mm, etc.) or other suitable width. The length of element 158 may be 1-10 cm, more than 2 cm, 2-7 cm, 1-5 cm, less than 10 cm, less than 5 cm, or other suitable length). The portions of slot 114 that separate element 158 from ground 104 and peripheral conductive housing structures 16 may have a width D2 of about 0.75 (e.g., more than 0.4, more than 0.6, less than 0.8, less than 1 mm, 0.3-1.2 mm, etc.).

Element 158 may resonate in a desired communications band and thereby provide enhanced frequency coverage for antenna 40 in the desired communications band (e.g., element 158 may resonant at frequencies in a high communications band at 2300-2700 MHz or other suitable band). Element 158 may be formed from a metal structure on a printed circuit, from a portion of a conductive housing structure, or from other conductive structures in device 10.

In the example of FIG. 6, slot 114 has a U shape. If desired, slot 114 may have other shapes such as the straight slot shape of slot 114 of FIG. 7. In an arrangement of the type shown in FIG. 6, the tip of element 158 may be bent to accommodate a bend of slot 114 at the corner of device 10. In the illustrative arrangement of FIG. 7, element 158 is straight and unbent. In other configurations for antenna 40, slot 114 and element 158 may have different shapes. The arrangements of FIGS. 6 and 7 are illustrative.

Figure 7:
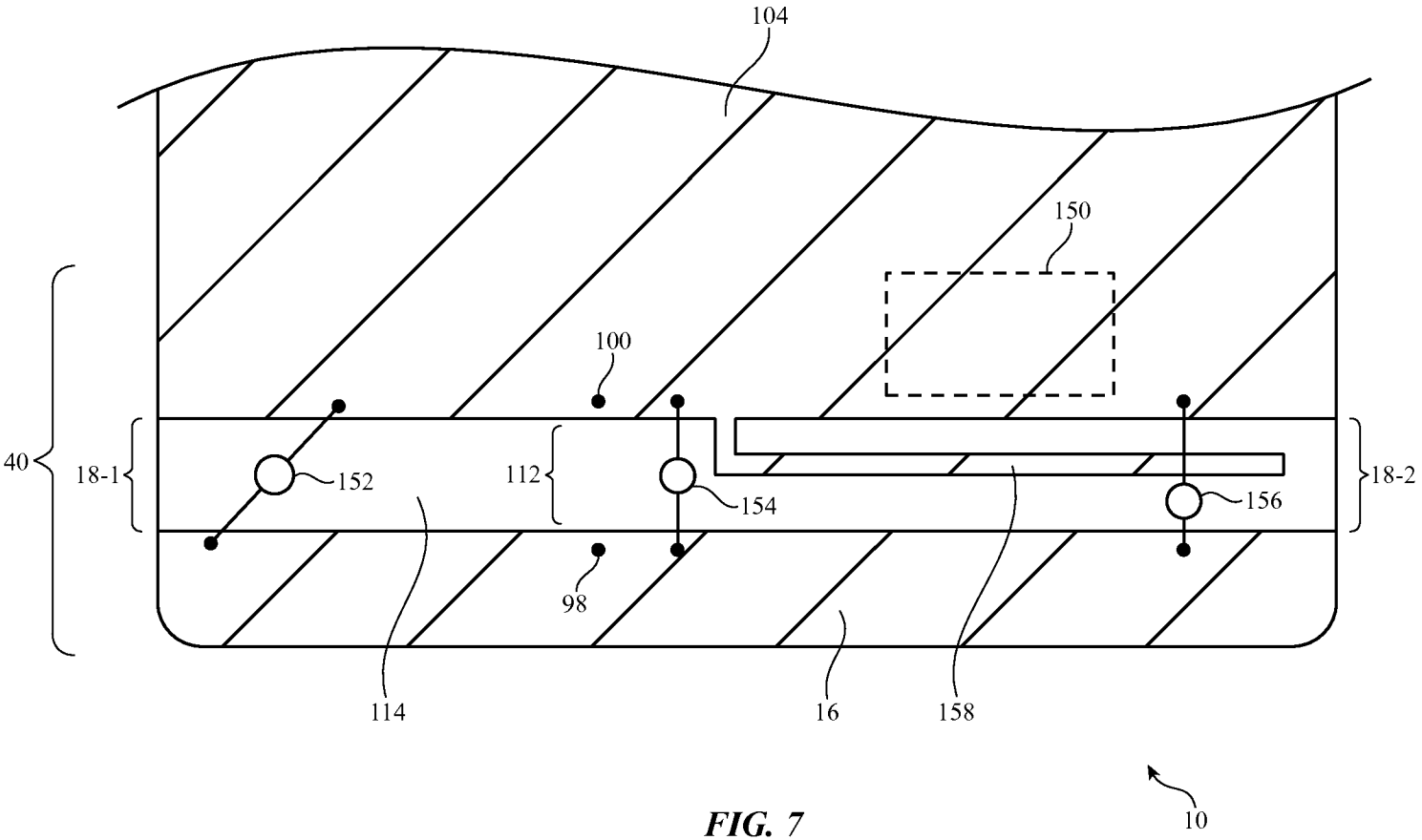
Figure 8:
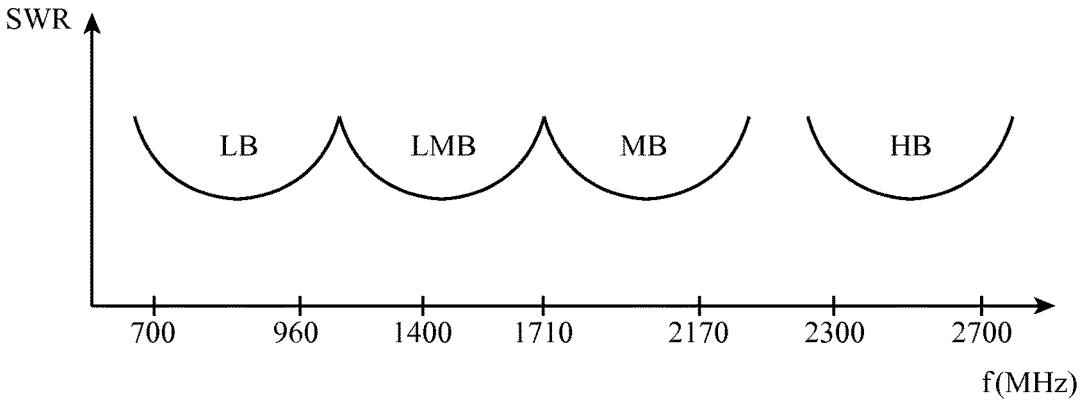
FIG. 8 is a graph in which antenna performance (standing wave ratio) has been plotted as a function of operating frequency in accordance with an embodiment.

FIG. 8 is a graph in which antenna performance (standing-wave ratio SWR) has been plotted as a function of operating frequency f for an illustrative antenna such as antenna 40 of FIGS. 6 and 7 (including parasitic element 158 and supplemental antenna element 150). As shown in FIG. 8, antenna 40 may exhibit resonances in a low band LB, low-middle band LMB, midband MB, and high band HB.

Low band LB may extend from 700 MHz to 960 MHz or other suitable frequency range. Peripheral conductive structures 16 may serve as an inverted-F resonating element arm such as arm 108 of FIG. 4. The resonance of antenna 40 at low band LB may be associated with the distance along peripheral conductive structures 16 between component 152 of FIG. 6 and gap 18-2. Gap 18-2 may be one of gaps 18 in peripheral conductive housing structures 16. FIG. 6 is a rear view of device 10, so gap 18-2 of FIG. 6 lies on the left edge of device 10 when device 10 is viewed from the front. Component 152 may include a switch that can be closed to form a return path for an inverted-F antenna (e.g., an inverted-F antenna that has a resonating element arm formed from structures 16) and/or other return path structures may be formed for antenna 40.

Low midband LMB may extend from 1400 MHz to 1710 MHz or other suitable frequency range. An antenna resonance for supporting communications at frequencies in low midband LMB may be associated with a monopole element, inverted-F antenna element, or other antenna element such as element 150.

Midband MB may extend from 1710 MHz to 2170 MHz or other suitable frequency range. Antenna 40 may exhibit first and second resonances in midband MB. A first of these midband resonances may be associated with the distance between feed 112 and gap 18-2. A second of these resonances may be associated with the distance between feed 112 and component 152 (e.g., a switch that may be used in forming a return path).

High band HB may extend from 2300 MHz to 2700 MHz or other suitable frequency range. Antenna performance in high band HB may be supported by the resonance of parasitic antenna resonating element 158 (e.g., the length of element 158 may exhibit a quarter wavelength resonance at operating frequencies in band HB).

Figure 9:
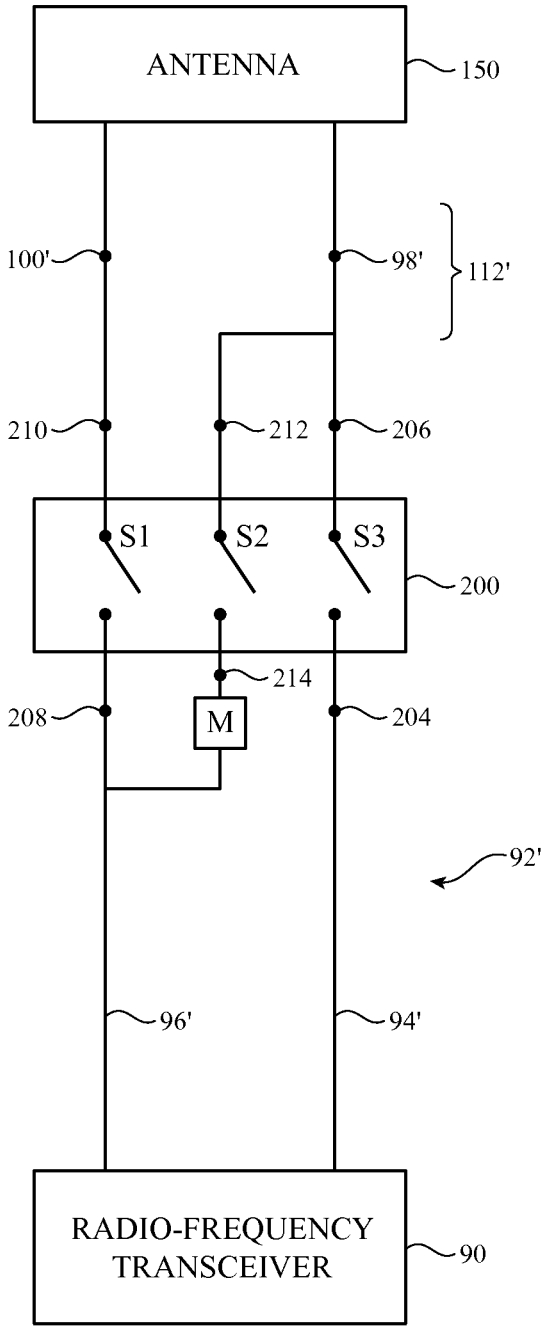
FIG. 9 is a diagram of a switchable antenna in accordance with an embodiment.

FIG. 9 is a diagram of an illustrative feed arrangement for antenna 150 (e.g., an inverted-F antenna). As shown in FIG. 9, radio-frequency transceiver circuitry 90 may be coupled to antenna 150 using a transmission line such as transmission line 92'. Transmission line 92' may have positive signal line 94' and ground signal lines 96'. Switching circuitry such as switching circuitry 200 may be interposed in transmission line 92' between feed 112' of antenna 150 and transceiver circuitry 90. Feed 112' may have a positive antenna feed terminal such as positive antenna feed terminal 98' and a ground antenna feed terminal such as ground antenna feed terminal 100'. Switching circuitry 200 may have switches such as switches S1, S2, and S3. Switches S1, S2, and S3 may be controlled by control signals from control circuitry 28.

As shown in FIG. 9, switch S3 may have a first terminal such as terminal 206 that is coupled to positive antenna feed terminal 98' and may have a corresponding second terminal such as terminal 204 that is coupled to positive signal line 94' in transmission line 92'. Switch S1 may have a first terminal such as terminal 210 that is coupled to ground antenna feed terminal 100' and a second terminal such as terminal 208 that is coupled to ground signal line 96' in transmission line 92. Switch S2 may have a first terminal such as terminal 212 that is coupled to terminal 98' and a second terminal such as terminal 214 that is coupled to impedance matching network M. Matching network M may be coupled between terminal 214 and line 96'.

Control circuitry 28 may operate antenna 150 in multiple states using switching circuitry 200. These states may include an isolation mode in which antenna 150 is isolated from the other antenna structures of device 10, a free space mode in which antenna 150 is configured for optimal operation in free space, a narrowband grip mode in which antenna 150 is configured to operate in a narrow communications band while held by a user, and a wideband grip mode in which antenna 150 is configured to operate in a wide communications band (e.g., a band that is wider than the narrow communications band) while held by a user. In the free space mode, antenna 150 may be configured to operate at a frequency of 1400 MHz (or other suitable frequency). When being used by a user, the resonance of antenna 150 has the potential to shift to a lower frequency. In the narrowband grip mode and the wideband grip mode, antenna 150 is configured to operate at its desired operation frequency (i.e., the resonance of antenna 150 is tuned upwards to its desired frequency by configuring switches S1, S2, and S3).

Antenna 150 may be configured to operate in the isolation mode by opening switches S1, S2, and S3. In this mode, antenna 150 is isolated from transmission line 92' and floats. While isolated in this way, antenna 150 may serve as a parasitic antenna resonating element for antenna 40 at frequencies of 2300-2700 MHz or other suitable frequencies (e.g., high band frequencies). Antenna 150 may be placed in the free space mode by closing switches S1 and S3 and opening S2 (to switch matching circuit M out of use). In the narrowband grip mode, switch S3 may be closed and switches S1 and S2 may be turned off. With switch S3 closed, antenna matching circuit M is switched into use to ensure that antenna 150 operates properly, even when gripped by a user. In the wideband grip mode, switches S1 and S3 are turned on and switch S2 is opened, providing antenna 150 with a wider bandwidth than the narrowband grip mode (although with somewhat reduced efficiency).

Figure 10:
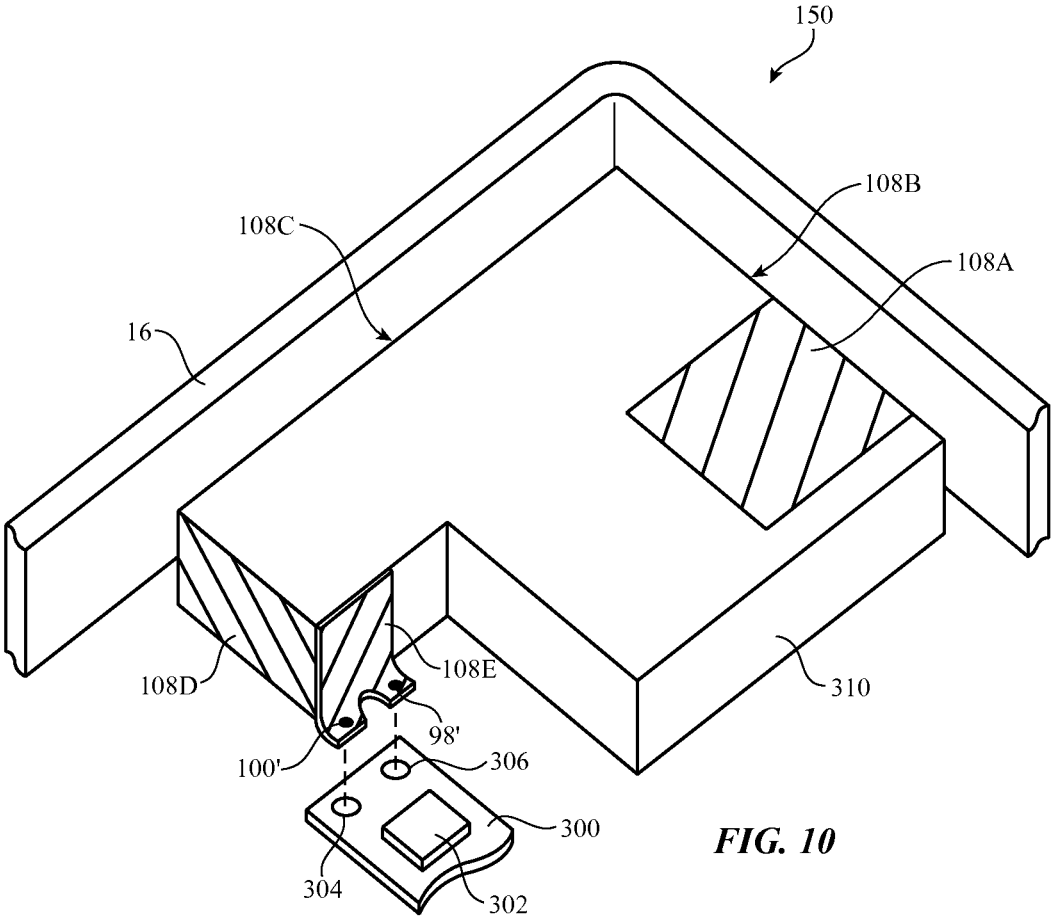
FIG. 10 is a perspective view of an illustrative antenna of the type shown in FIG. 9 in accordance with an embodiment.
Figure 11:
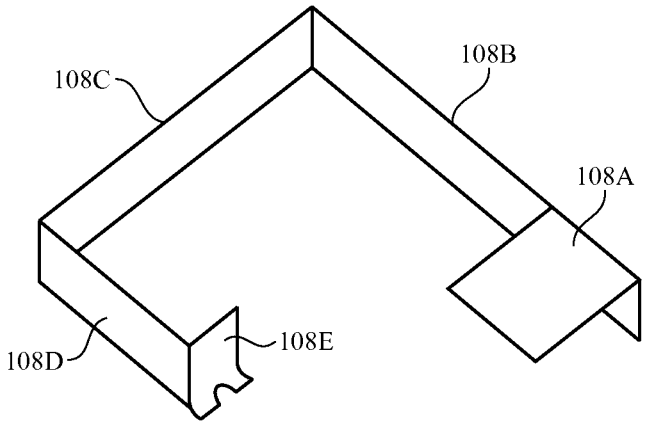
FIG. 11 is a perspective view of a metal antenna resonating element for the antenna of FIG. 10 in accordance with an embodiment.

FIG. 10 is a perspective view of antenna 150. Antenna 150 may be an inverted-F antenna that includes an antenna resonating element (see, e.g., arm 108 of FIG. 4) and antenna ground 104. The antenna resonating element of antenna 150 may have antenna resonating element arm segments 108A, 108B, 108C, 108D, and 108E. The resonating element may be formed from metal having the shape of shown in FIG. 11 (as an example). As shown in FIG. 11, the resonating element arm may have three or more right-angle bends and three or more or four or more segments. This resonating element may be supported by a dielectric support structure such as plastic support structure 310 of FIG. 10.

Transmission line 92' may be implemented using signal traces on flexible printed circuit 300. Matching network M may be formed by components mounted on flexible printed circuit 300 such as component 302. Components such as component 302 may also be used to form switching circuitry 200. Pads 304 and 306 allow the transmission line signal conductors of printed circuit 300 and the matching network M of component(s) 302 to be coupled to respective antenna terminals 100' and 98'. Antenna 150 may be electromagnetically coupled to the antenna (e.g., antenna 40) formed from peripheral conductive structures 16. During use of antenna 150, structures 16 may serve as a parasitic antenna resonating element for antenna 150 that improves antenna efficiency.

Although described in the context of an inverted-F antenna, antenna 150 may be implemented using any suitable type of antenna (patch, inverted-F, monopole, loop, slot, hybrid, etc.) and may be implemented using conductive structures formed from portions of housing 12, internal metal structures in device 10 (e.g., interior metal housing members), metal traces on a printed circuit such as a rigid printed circuit board or a flexible printed circuit, laser-patterned electroplated traces on a plastic carrier, metal foil, metal parts embedded into or attached to a molded plastic carrier or other dielectric support structure, wire, or other conductive structures. In the arrangement of FIG. 10, antenna structures for antenna 150 may be formed from metal structures (metal traces, metal foil, etc.) that form an antenna resonating element arm supported by a plastic carrier (carrier 310). This type of support arrangement for the metal structures of antenna 150 is merely illustrative. Other types of antenna structures may be used in forming antenna 150, if desired.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a peripheral conductive structure;

a first antenna that has a first resonating element arm formed from the peripheral conductive structure, that has an antenna ground that is separated from the first antenna resonating element arm by a slot that runs parallel at least one edge of the housing, and that has a first antenna feed;

a second antenna formed from a second resonating element arm and the antenna ground, wherein the second antenna has a second antenna feed and the peripheral conductive structure forms a parasitic antenna resonating element for the second antenna;

a first transmission line coupled to the first antenna feed;

switching circuitry; and a second transmission line coupled to the second antenna feed by the switching circuitry.

2. The electronic device defined in claim 1 further comprising control circuitry that is configured to place the switching circuitry in a freespace mode of operation in which the second transmission line transmits and receives antenna signals for the second antenna through the switching circuitry.

3. The electronic device defined in claim 2 wherein the control circuitry is further configured to place the switching circuitry in an isolation mode of operation in which the second antenna is electrically isolated from the second transmission line.

4. The electronic device defined in claim 3 wherein the control circuitry is further configured to place the switching circuitry in at least one additional mode of operation in which the antenna is tuned to ensure operation at a desired frequency range when gripped by a user.

5. The electronic device defined in claim 3 wherein the second antenna further comprises a plastic carrier that supports the second resonating element arm.

6. The electronic device defined in claim 5 further comprising a flexible printed circuit, wherein the second transmission line includes conductive lines on the flexible printed circuit.

7. The electronic device defined in claim 6 further comprising an additional parasitic antenna resonating element in the slot.

8. The electronic device defined in claim 7 wherein the switching circuitry is mounted on the flexible printed circuit.

9. The electronic device defined in claim 3 wherein the second antenna comprises a tunable inverted-F antenna.

10. The electronic device defined in claim 9 wherein the second antenna is configured to resonate in a frequency band that includes a frequency of 1400 MHz.

11. The electronic device defined in claim 1 wherein the first antenna feed has a first positive antenna feed terminal coupled to the first antenna resonating element arm and wherein the second antenna feed has a second positive antenna feed terminal coupled to the second antenna resonating element arm.

12. The electronic device defined in claim 1 wherein the second antenna resonating element arm has at least four segments and three right-angle bends.

13. An electronic device, comprising:

a metal housing with a slot that separates the metal housing into a peripheral conductive housing structure that forms a first antenna resonating element arm and an antenna ground, wherein the first antenna resonating element arm and the antenna ground form a first antenna;

switching circuitry having first and second states; and a second antenna coupled to the switching circuitry, wherein the second antenna includes a second antenna resonating element arm and the antenna ground, the second antenna resonating element arm is coupled to radio-frequency transceiver circuitry when the switching circuitry is in the first state, and the second antenna resonating element arm is configured to serve as a parasitic antenna resonating element for the first antenna when the switching circuitry is in the second state.

14. The electronic device defined in claim 13 further comprising a transmission line that couples the transceiver circuitry to the switching circuitry.

15. The electronic device defined in claim 14 further comprising control circuitry that is configured to adjust the switching circuitry to place the switching circuitry in a selected one of the first and second states.

16. The electronic device defined in claim 15 wherein the transceiver circuitry is configured to transmit and receive antenna signals with the first antenna while the switching circuitry is in the second state.

17. The electronic device defined in claim 16 further comprising a plastic carrier that supports the second antenna resonating element.

18. The electronic device defined in claim 17 wherein the second antenna resonating element arm is configured to resonate at a communications band including a frequency of 1400 MHz.

19. An electronic device, comprising:

a metal housing having a sidewall portion that runs along an edge of the electronic device and having a planar rear wall portion that forms a portion of a ground, wherein the sidewall portion and the planar rear wall portion are separated by a slot;

an antenna resonating element arm formed from a metal structure on at least two sides of a plastic carrier;

switching circuitry coupled to the antenna resonating element arm; and transceiver circuitry coupled to the antenna resonating element arm by the switching circuitry, wherein the switching circuitry is operable in a first mode in which the switching circuitry couples the transceiver circuitry to the antenna resonating element arm and a second mode in which the switching circuitry isolates the transceiver circuitry from the antenna resonating element arm.

20. The electronic device defined in claim 19 wherein the antenna resonating element arm serves as part of an antenna that operates in a communications band, the electronic device further comprising a parasitic antenna resonating element arm in the slot, wherein the sidewall portion, the parasitic antenna resonating element arm, and the ground form an additional antenna that operates at frequencies that are outside of the communications band.

21. The electronic device defined in claim 20 wherein the antenna resonating element arm of the antenna serves as a parasitic antenna resonating element for the additional antenna at the frequencies that are outside of the communications band while the switching circuitry is operated in the second mode.

* * * * *